US006192915B1

(12) United States Patent
Valperz et al.

(10) Patent No.: US 6,192,915 B1
(45) Date of Patent: Feb. 27, 2001

(54) SEWERAGE INLET

(75) Inventors: Antonius Valperz, Am Fehiberg; Hartwig Langenberg, Dammstrasse, both of (DE)

(73) Assignee: Anke Valperz, Reichshof (DE)

( * ) Notice: Subject to any disclaimer, the term of this patent is extended or adjusted under 35 U.S.C. 154(b) by 0 days.

(21) Appl. No.: 09/202,391

(22) PCT Filed: Jun. 11, 1997

(86) PCT No.: PCT/EP97/03025

§ 371 Date: Jun. 10, 1999

§ 102(e) Date: Jun. 10, 1999

(87) PCT Pub. No.: WO97/47829

PCT Pub. Date: Dec. 18, 1997

(30) Foreign Application Priority Data

Jun. 14, 1996 (DE) ..... 196 23 869

(51) Int. Cl.[7] ..... E03F 5/04; E03F 5/16

(52) U.S. Cl. ..... 137/172; 137/247.21; 137/247.33; 137/247.35; 137/247.39

(58) Field of Search ..... 137/172, 247.21, 137/247.33, 247.35, 247.39

(56) References Cited

U.S. PATENT DOCUMENTS 288,655 * 11/1883 Muirhead ..... 137/247.21 X
1,067,610 * 7/1913 Ibbeken ..... 137/247.33 X
1,995,742 * 3/1935 Linnmann, Jr. ..... 137/172 X
2,551,404 * 5/1951 Wiggins ..... 137/172 X
4,026,317 * 5/1977 Ekstrom ..... 137/247.39 X
4,132,238 * 1/1979 Clark ..... 137/172
4,748,999 * 6/1988 Delwiche ..... 137/172
5,297,367 * 3/1994 Sainz ..... 137/247.33 X

* cited by examiner

*Primary Examiner*—John Rivell
(74) *Attorney, Agent, or Firm*—Hoffman & Baron, LLP

(57) ABSTRACT

Sewerage inlet having a grating (3), a foliage-retaining basin (4) arranged below said grating (3) and a container provided with an outflow pipe (6) in which container a valve (10) controlled by a float is arranged upstream of the outflow pipe (6) and closes said outflow pipe (6) when the liquid in the container is lighter than water.

Figure 1:
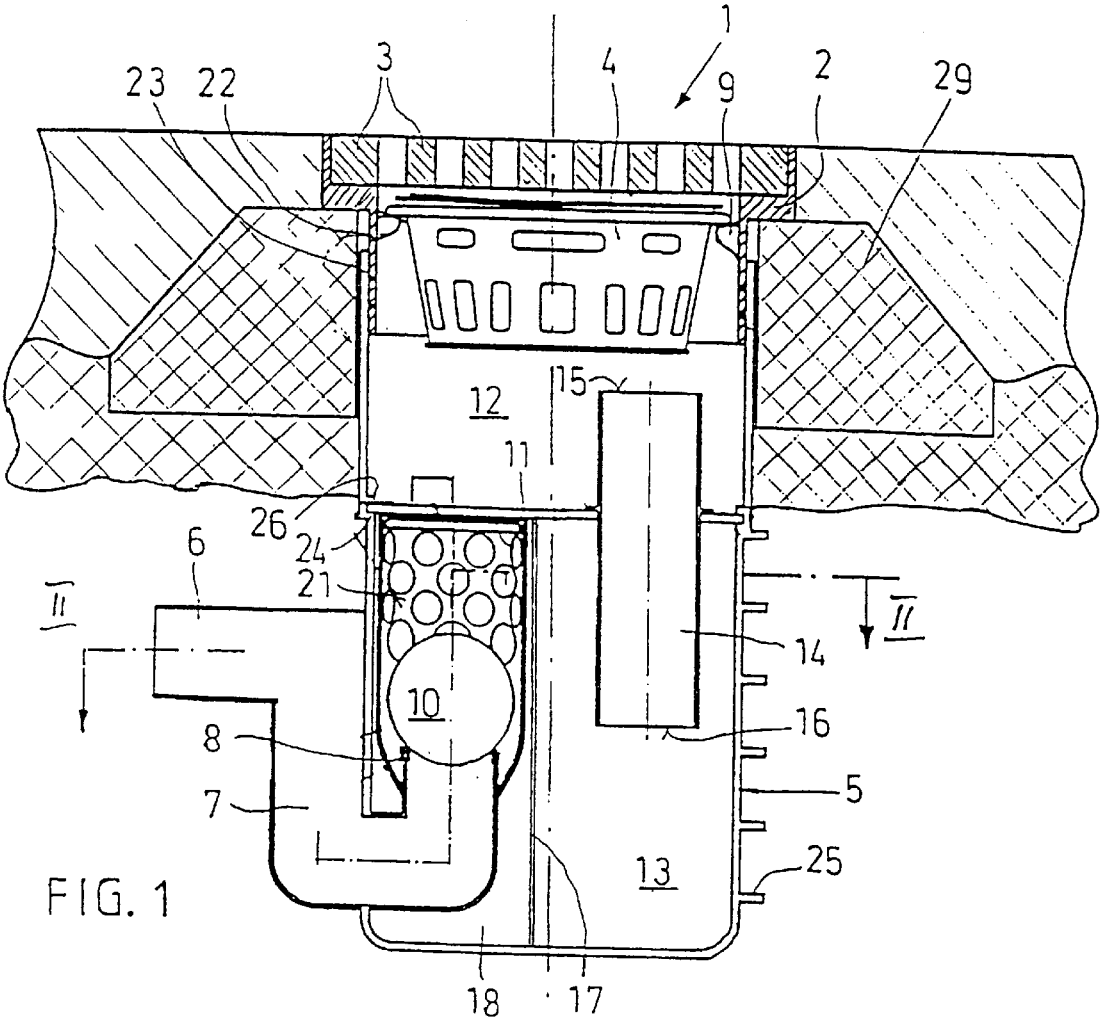

For conveying the surface water away from streets, grounds and production yards a sewerage inlet is proposed, the container (5) thereof being subdivided by a removable separating floor (11) into an upper sedimentation chamber (12) and a lower collection chamber (13) into which the outflow inlet (8) connected with said outflow pipe (6) having a valve (10) and a float are arranged and whereby said sedimentation chamber (12) is connected via a soil pipe (14) with said collection chamber (13), the inlet opening (15) thereof being at a relatively large distance from said separating floor (11) and the outlet opening (16) being below said outflow pipe (6).

16 Claims, 3 Drawing Sheets

SEWERAGE INLET

FIELD OF THE INVENTION

The invention relates to a sewerage inlet with a grating, a foliage-retaining basin arranged below the grating and a container provided with an outflow pipe, in which a valve controlled by a float is arranged upstream of the outflow pipe and which closes the outflow pipe when the liquid in the container is lighter than water.

BACKGROUND OF THE INVENTION

A sewerage inlet of this type is known from the Utility Model DE 93 11 176. The known sewerage inlet serves the drainage of heating cellars. It is provided with a permanently closed seal, which only opens when water runs in and remains closed, if fuel oil or another liquid which is lighter than water flows into the container.

This known sewerage inlet is unsuitable for the drainage of surface water on streets, grounds, production yards and the like because the container respectively the outflow housing has no storage volume and therefore would overflow already when running off small volumes of water and the float and the valve are arranged such in the discharge current that due to the turbulences occurring there a reliable closing of the valve upon influx of petrol, diesel oil or heating oil cannot be expected.

To protect the groundwater and the surface waters the arrangement of separators in the canalisation is known, in which light liquids such as petrol, benzol, oil or diesel are separated from water.

Despite these separators considerable damages occur frequently when, for example, in the case of a carambolage of a tanker convoy oil or petrol flow into a gully and from there via canalisation into the groundwater or streams or rivers. Here it is to be taken into consideration that the sewage pipes are frequently not joined together tightly and also are not connected tight to the inlet shaft of a gully.

SUMMARY OF THE INVENTION

The present invention is based on the task of creating a sewerage water inlet for roads, grounds or production yards, whereby the described defects of the known sewerage water inlets are avoided and whereby it is ensured that oil and petrol do not get into the canalisation. In doing so the sewerage water inlet should cost only little to manufacture, be easily mounted and be operationally reliable.

This task is solved according to the invention in that the container is subdivided by a removable separating floor into an upper sedimentation chamber and a lower collection chamber, in which the outflow inlet connected with the outflow pipe is arranged with valve and float and the sedimentation chamber is connected via a soil pipe with the collection chamber, the inlet opening whereof being located at a relatively long distance from the separating floor near to the bottom of the foliage-retaining basin and the outlet opening whereof being below the outflow pipe.

With this device a compact multiple-chamber system is created whereby a sedimentation chamber is located below the foliage-retaining basin and above the collection chamber into which collection chamber the sludge found in the sewerage water can settle. Furthermore it is compactly arranged that the path of the sewage from the inlet to the outflow pipe is relatively long and the float and the valve are located in a stabilized efflux zone. In this way it is achieved that the inflowing water, petrol or oil mixture is collected in the collection chamber, the lighter liquid is separated from the water and floats to the surface and the outflow inlet is closed when the water level in the collection chamber has dropped so far that the valve connected with the float settles on the outflow inlet and closes this.

A run-off of oil, petrol or the like into the canalisation is thereby prevented.

The outflow pipe is advantageously connected via a U-shaped, siphon-type manifold with the outflow inlet closable by the valve. On the horizontal outflow inlet there is a conical or spherical closing member, which simultaneously acts as floating member. The weight of this closing member is so counterbalanced that its specific weight is lighter than water but heavier than oil, petrol, benzol or the like. The level of the outflow inlet provided with a sealing lip is somewhat below the lowest point of the outflow pipe.

The float and closing member is fed within an essentially cylindrical housing, which is connected tightly at the bottom with the manifold and has in the upper region perforations, through which the sewerage water flows into the guide housing.

Expediently a valve chamber in which the valve with guide housing is accommodated is separated from the collection chamber via a vertical partition or separating panel. In this partition there is an overflow opening, which connects the valve chamber with the collection chamber. In this way it is achieved that the valve is located in a stabilized zone. For this purpose another coalescence filter is arranged between the overflow opening in the separating panel and the valve, so that droplets of oil in the sewage flowing through the filter are filtered out, rise upwards and settle on the water level.

In the further embodiment of the invention it is suggested that the container be slidably connected with the frame supporting the grating and the frame be supported on a concrete ring, so that the forces acting upon the grating and the frame are not conveyed to the container. The container can advantageously be made of recycled polyethylene.

Figure 2:
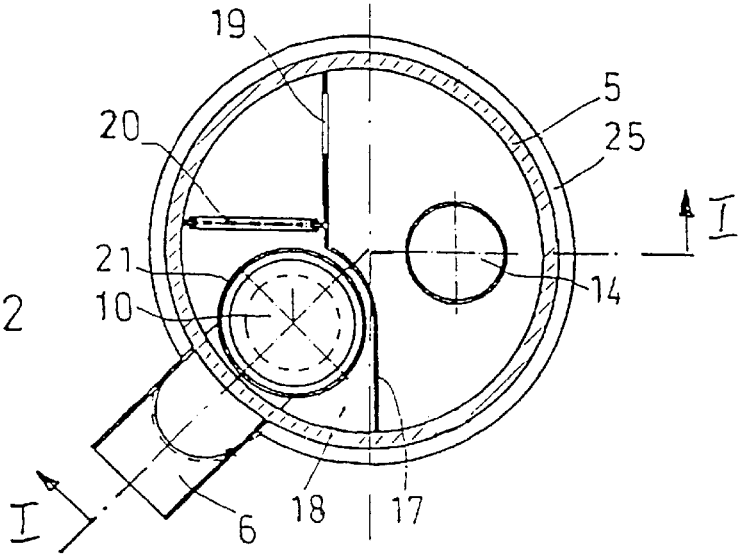
Figure 3:
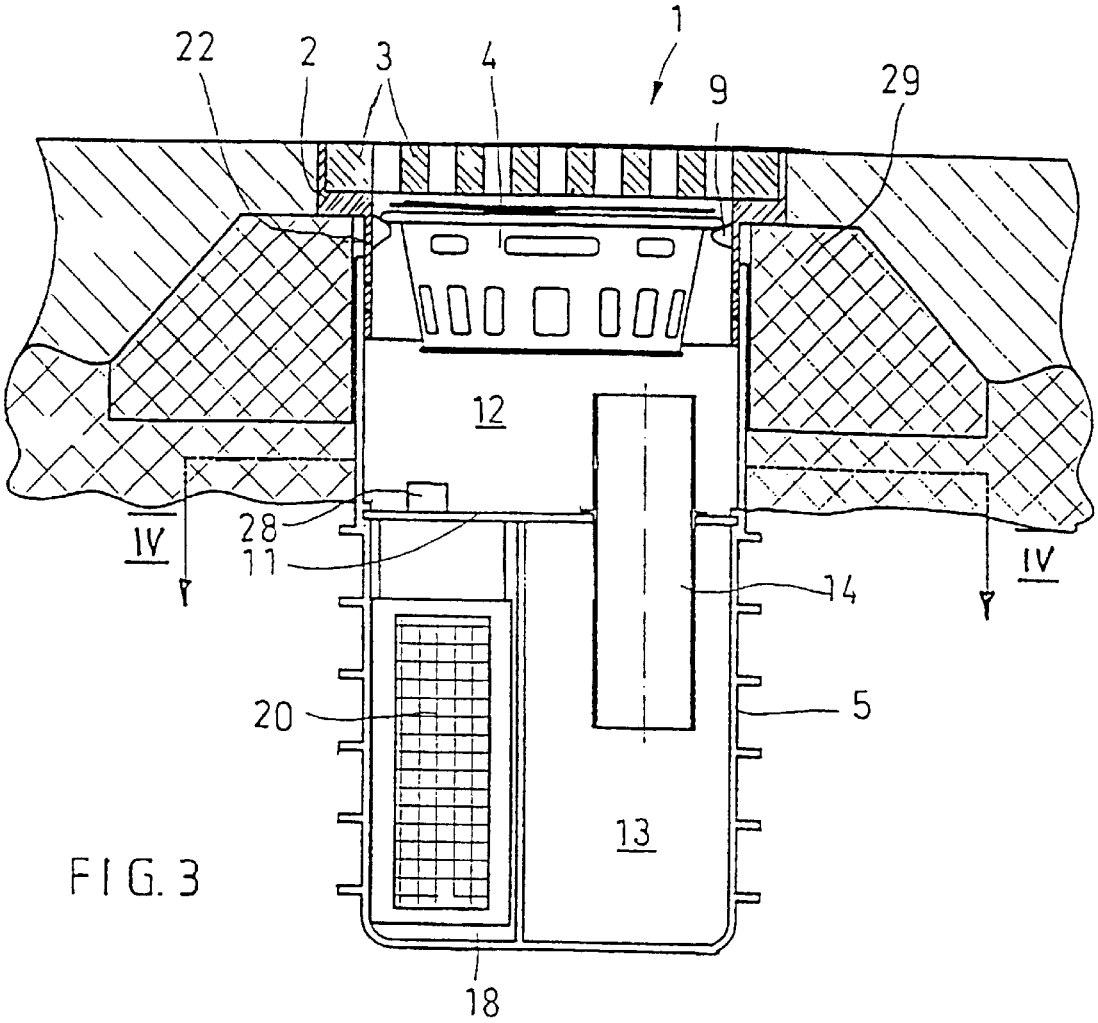
Figure 4:
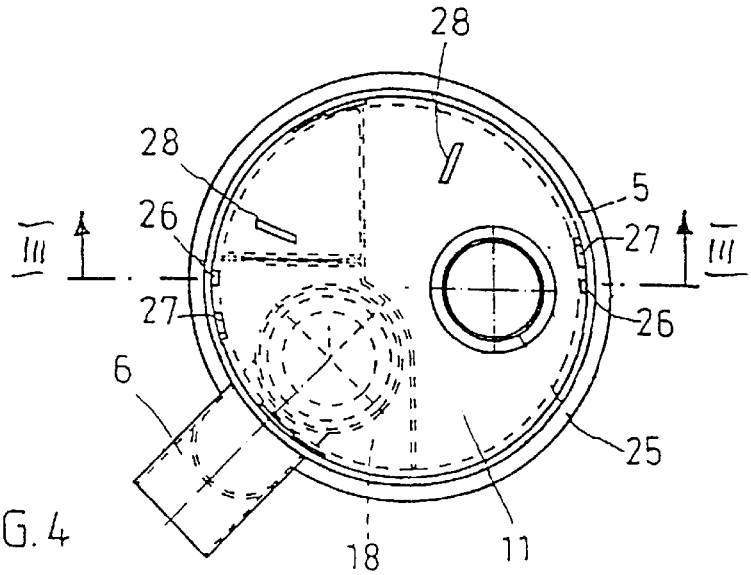
Figure 5:
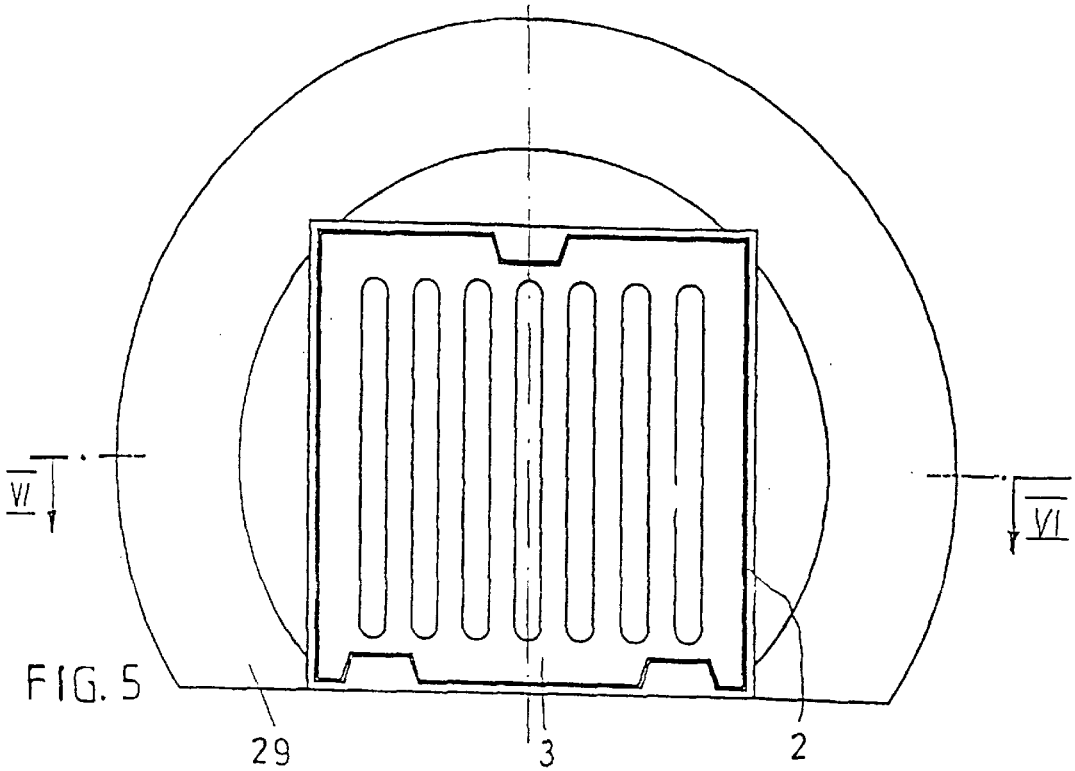

Further features of the invention arise from the patent claims and from the following specification, in which an embodiment example of the invention is more closely explained with reference to the drawings. The drawings show in FIG. 1 a sectional view of the sewerage inlet according to the invention in accordance with line I—I in FIG. 2, FIG. 2 a view according to the line II—II in FIG. 1, FIG. 3 a view according to the line III—III in FIG. 4, FIG. 4 a view according to the line IV—IV in FIG. 3, FIG. 5 a top view of the grating of the sewerage water inlet and FIG. 6 a sectional view of the sewerage water inlet according to FIG. 1 with valve open.

The sewerage inlet according to FIG. 1 is intended for streets, production yards, grounds, gutters or ditches along the motorways. It has a frame 2, which is supported by a concrete ring 29. The opening surrounded by the frame 2 is covered by a grating 3. In the frame 2 mountings 9 are fitted on which the upper edge of the foliage-retainer basin 4 rests. The frame 2 has a collar 22 extending downwards which is overlapped by the upper edge of a container 5. The cross-section of the collar 22 corresponds to the clear width of the container 5. The container 5 is sealed off via two seals 23 from the collar 22. The sealing rings 23 are located in the annular grooves which are fitted into the outer side of the collar 22 or the inner side of the container 5. In this way forces which act upon the grating 3 and the frame 2 cannot be transmitted to the container 5 as this container is connected vertically slidable with the collar 22 on the frame 2 supported by the concrete ring 29.

The outflow pipe of the container 5 is connected with the container 5 via a manifold 7 acting as siphon. The manifold 7 has a horizontal outflow inlet 8, which is closable by the closing member of a valve 10.

Figure 6:
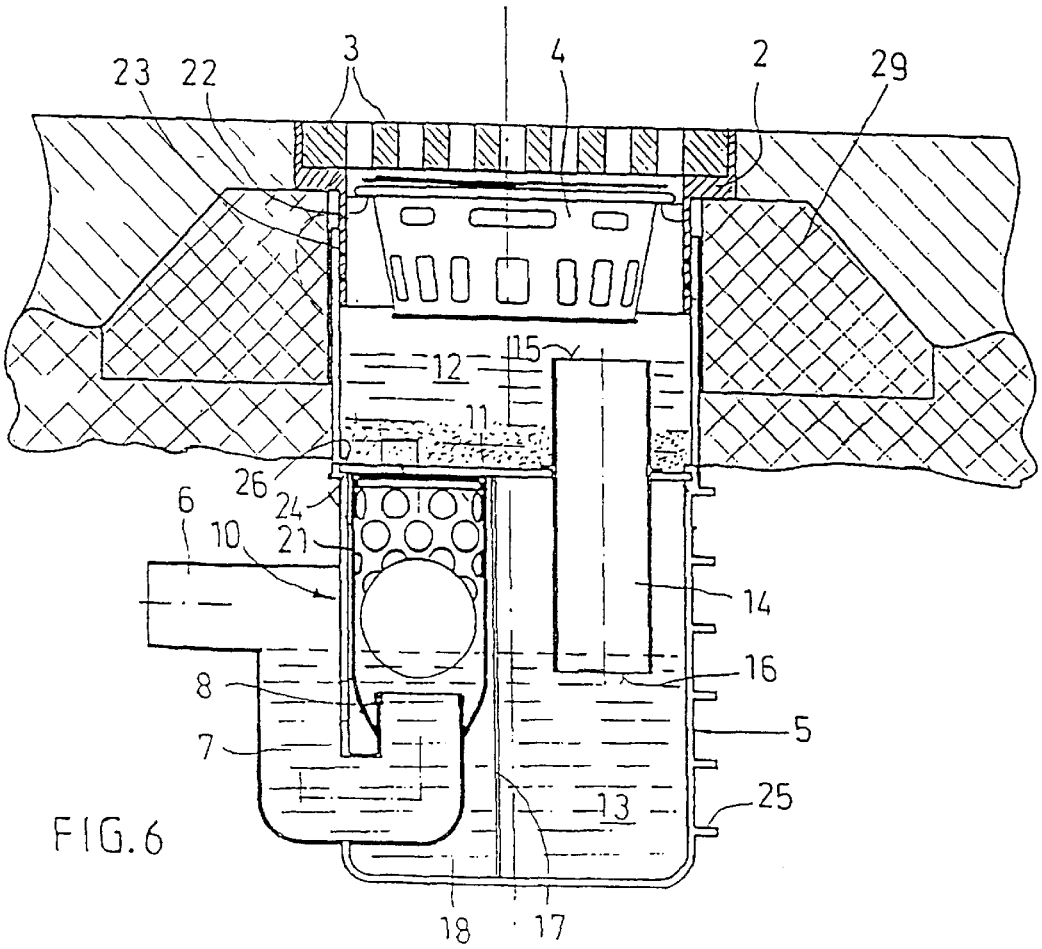

In the case of the embodiment shown the closing member of the valve 10 is simultaneously also the floating member, which seals or opens the outflow inlet 8. This floating and closing member 10 is lighter than water, with the result that it—as FIG. 6 shows—floats on the water and so opens the outflow inlet 8. If the conical or spherical float 10 is surrounded by a liquid which is lighter than water, then this body sinks deeper into the liquid level and so seals the outflow inlet 8. In order to guarantee a reliable and sealed fit of the float and closing member 10, the upper edge of the U-shaped manifold 7 is fitted with an elastic sealing lip.

The valve formed from the outflow inlet 8 and the float and closing member 10 is located within a cylindrical guide housing, which guides the float and closing member vertically movable and the wall whereof is fitted with perforations such that the sewage or even also the liquid to be retained can flow into the guide housing.

Reinforcing or stiffening ribs 25 are molded on the outside of container 5 so as to circumscribe the container. The container 5 is subdivided by a removable separating floor 11 into an upper sedimentation chamber 12 and a lower collection chamber 13. The sedimentation chamber 12 is connected via a soil pipe 14 with the collection chamber 13. The inlet opening 15 of the soil pipe 14 is located at a relatively large distance from the separating floor 11 near to the base of the foliage-retaining basin 4. The outlet opening 16 of the soil pipe 14 is located below the outflow pipe 6. In this way—as FIG. 6 shows—a sedimentation basin 12 is created in which the sludge located in the sewerage can settle. Container 5 includes a shoulderlike support 24 for separating floor 11. Inwardly protruding lugs 26 are molded at a distance from support 24 corresponding to a thickness of separating floor 11. Lugs 26 form part of a bayonet catch in correspondence with recesses 27 at the edge of separating floor 11. By swivelling the separating floor to a stop the recesses 27 at the edge of the separating floor 11 can be brought under the bayonet lugs 26 such that the separating floor 11 can be removed. Handles 28 on the separating floor 11 serve to make the separating floor easier to get hold of and to move.

As the FIG. 6 shows, the height of the outflow pipe 6 is selected such that the level of the water in the collection basin 13 and in the valve and filter chamber 18 raises the floating and closing member and opens the outflow inlet 8. If, however, a lighter fluid were to be located in the valve and filter chamber 18 instead of water, then the floating and closing member 10 settles on the edge of the outflow inlet 8 fitted with an elastic seal and closes this inlet.

The operating mode of the sewerage inlet according to the invention is as follows. The sewage flows through the grating into the foliage-retaining basin 4. There foliage and greater contaminations are retained. Via the perforations in the foliage bucket resp. in the foliage-retaining basin 4 the sewage passes into the sedimentation chamber 12 in which the sludge is deposited. The sewage freed from sludge arrives then via the drainage edge 15 of the soil pipe 14 in the collection chamber 13. Here there is a stabilization of the effluent medium. The remainder of the floating particles sinks further, so that only water and oils or fuels therein contained pass through the the overflow opening 19 in the partition (dividing wall 17) into the valve- and filter chamber 18. The liquids which are lighter than water collect above the water level. This oil cannot enter into the outflow inlet 8 because the float and closing member of the valve 10 immediately settles on this outflow inlet 8, if it is surrounded by a liquid which is lighter than water.

Downstream of the overflow opening 19 in the separating wall 17 and upstream of the guide housing 21 a coalescence filter 20 is arranged, which filters out small and minute droplets of oil or petrol out of the flowing sewage and unites them into larger droplets, which then rise to the top to the oil layer floating on the sewage. If larger quantities of oil get through the coalescence filter, then these press the water located under the oil layer through the outflow inlet 8, until the floating and closing member is only located in the oil or fuel and thereby lowers and closes the outflow inlet 8.

To clean the sewerage inlet the grating 3 is lifted off and the foliage-retaining basin 4 suctioned out and then lifted out of the gully. Now the sedimentation chamber 12 can be suctioned out and then by swivelling of the separating floor 11 by several degrees the separating floor 11 can be removed, so that also the collection chamber 13 as well as the valve- and filter chamber 18 can be suctioned out and cleaned. The panel-like coalescence filter 20 can be pulled upwards and cleaned with a water jet or exchanged. Valve 10 is also accessible from above and its parts can be cleaned.

In order to avoid damage of the valve 10 in the event of uncautious suctioning of the collection chamber 13, another lid can be fitted on the guide housing 21, which must be removed before one can obtain access to the parts of the valve 10.

References

1 Inlet
2 Frame
3 Grating
4 Foliage-retaining basin
5 Container
6 Outflow pipe
7 Manifold
8 Outflow inlet
9 Mounting
10 Valve
11 Separating floor
12 Sedimentation chamber
13 Collection chamber
14 Soil pipe
15 Inlet opening
16 Outlet opening
17 Dividing wall/partition
18 Valve chamber
19 Overflow
20 Coalescence filter
21 Cylinder
22 Collar
23 Sealing ring
24 Support
25 Stiffening ribs
26 Lug
27 Recess

28 Handle

29 Concrete ring

What is claimed is:

1. A sewerage inlet, comprising:

a grating;

a foliage retaining basin below said grating and including a bottom surface; and a container subdivided by a removable separating floor into an upper sedimentation chamber and a lower collection chamber provided with an outflow pipe having an outflow inlet, in which container a valve controlled by a float is located upstream of said outflow pipe adjacent said outflow inlet such that said valve closes said outflow pipe when a liquid in said container is lighter than water, and in which said sedimentation chamber is connected to said collection chamber via a soil pipe which includes an inlet opening located at a distance above said separating floor and below said bottom surface of said foliage-retaining basin sufficient to allow accumulation of solid matter upon said separating floor and fluid flow through said inlet opening.

2. A sewerage inlet according to claim 1, wherein said container is substantially cylindrical.

3. A sewerage inlet according to claim 1, wherein said container is made of polyethylene.

4. A sewerage inlet according to claim 3, wherein at least one reinforcing rib is molded onto said container.

5. A sewerage inlet according to claim 1, wherein said separating floor is held in said container by means of a bayonet catch.

6. A sewerage inlet according to claim 5, wherein said container provides a shoulder-like support for said separating floor.

7. A sewerage inlet according to claim 1, wherein said container further provides a plurality of inwardly protruding lugs molded thereon at a distance from said support corresponding to a thickness of said separating floor.

8. A sewerage inlet according to claim 1, wherein said collection chamber further includes a valve chamber, and a separating panel having an overflow opening arranged in an upper region thereof through which said collection chamber is in fluid communication with said valve chamber.

9. A sewerage inlet according to claim 8, wherein an exchangeable coalescence filter is arranged between said overflow opening in said separating panel and said valve.

10. A sewerage inlet according to claim 1, wherein said float of said valve is a spherical or conical closing member settling on said outflow inlet, which member is movable within a perforated cylindrical housing thereadjacent.

11. A sewerage inlet according to claim 1, wherein said grating rests on a frame, having a collar extending downwards and adapted to clear a width of said container onto which collar said upper end of said container is slidable and tightly fitting via at least one sealing ring.

12. A sewerage inlet according to claim 11, wherein at least one groove is fitted at an outer side of said collar to accommodate a sealing ring therein.

13. A sewerage inlet according to claim 11, wherein at least one groove is fitted at an inner side of said container to accommodate a sealing ring therein.

14. A sewerage inlet according to claim 11, wherein said frame is held by a concrete ring.

15. A sewerage inlet according to claim 1, wherein said outflow inlet is connected via a siphon-type manifold with said outflow pipe and wherein a lowermost part of said outflow pipe is higher than said outflow inlet.

16. A sewerage inlet according to claim 1, wherein said sedimentation chamber, located above said separating floor, is separable from said collection chamber, located below said separating floor.

* * * * *